US007445500B2

(12) United States Patent
Bertoncini et al.

(10) Patent No.: US 7,445,500 B2
(45) Date of Patent: Nov. 4, 2008

(54) ELECTRICAL CONNECTOR STABILITY ENHANCEMENT

(75) Inventors: Daniel B. Bertoncini, Allen, TX (US); Timothy W. Houtz, Etters, PA (US); Joseph B. Shuey, Camp Hill, PA (US); Lewis R. Johnson, Dover, PA (US)

(73) Assignee: FCI Americas Technology, Inc., Carson City, NV (US)

( * ) Notice: Subject to any disclaimer, the term of this patent is extended or adjusted under 35 U.S.C. 154(b) by 0 days.

(21) Appl. No.: 11/627,767

(22) Filed: Jan. 26, 2007

(65) Prior Publication Data

US 2008/0182445 A1 Jul. 31, 2008

(51) Int. Cl.
*H01R 13/73* (2006.01)

(52) U.S. Cl. ..... 439/571

(58) Field of Classification Search ..... 439/571, 439/567, 572, 78, 83
See application file for complete search history.

(56) References Cited

U.S. PATENT DOCUMENTS 4,695,106 A * 9/1987 Feldman et al. ..... 439/83
4,753,601 A * 6/1988 Cobaugh et al. ..... 436/62
4,953,061 A 8/1990 Nitkiewicz ..... 361/417
5,071,371 A 12/1991 Harwath et al. ..... 439/637
5,312,264 A * 5/1994 Thomas et al. ..... 439/247
5,588,849 A * 12/1996 Kile ..... 439/83
5,642,266 A 6/1997 McCartney ..... 361/809
5,697,812 A 12/1997 Sampson et al. ..... 439/567
5,751,556 A * 5/1998 Butler et al. ..... 361/773
5,823,826 A 10/1998 Ward et al.
6,719,586 B2 4/2004 Weidner ..... 439/581
2002/0142651 A1 10/2002 Hashimoto et al.
2004/0253863 A1 12/2004 Iwasaki

FOREIGN PATENT DOCUMENTS

WO WO 2006035767 A1 4/2006

* cited by examiner

*Primary Examiner*—Phuong K Dinh
(74) *Attorney, Agent, or Firm*—Woodcock Washburn LLP

(57) ABSTRACT

An electrical connector may include a connector housing and a first alignment post. The first alignment post may extend from the bottom of the connector housing. The electrical connector may further include a protrusion that extends from the bottom of the connector housing. The protrusion may impede the electrical connector from tipping in at least one direction relative to a substrate. Additionally, the protrusion may be positioned relative to the center of gravity of the electrical connector to impede the electrically connector from tipping in at least one direction relative to the substrate.

12 Claims, 4 Drawing Sheets

ELECTRICAL CONNECTOR STABILITY ENHANCEMENT

FIELD OF THE INVENTION

The present invention relates to electrical connectors. More specifically, the present invention relates to stabilizing electrical connectors on a substrate.

BACKGROUND OF THE INVENTION

An electrical connector may be mounted to a substrate, such as a printed circuit board, for example. For example, a plug connector may be loosely placed in communication with a receptacle connector on such a substrate, thus creating a "sub-assembly." The sub-assembly may then be transported to a "pressing area," where the electrical connectors are press-fit onto the substrate.

It is known that typical electrical connectors tend to topple during transportation of the sub-assembly to the pressing area. Consequently, the connectors must be re-assembled to the substrate before press fitting. It would be advantageous, therefore, to have an electrical connector with a stability system that impeded toppling of the connector during transportation to the pressing area.

SUMMARY OF THE INVENTION

The invention provides a stability system for manufacturing electrical connector systems. Such a system may provide increased stability during transportation of a sub-assembly wherein the electrical connector is loosely mounted onto a substrate. By increasing the stability of the sub-assembly, such a stability system reduces the need to re-assemble the connector to the substrate after transport to a pressing area and prior to the connector being pressed to a seated position in the electrical component.

In an example embodiment, such a stability system may include at least one collapsible leg. The collapsible leg may be molded to the front portion of the electrical connector. When the electrical connector is placed into its respective position on the substrate, the collapsible leg may rest on the electrical component acting as a back stop should the electrical connector begin to topple. An alternative embodiment may include attaching the collapsible leg with one or more webs of plastic. The webs of plastic may provide an interference fit in a recess of the electrical connector. Upon collapse of the webs of plastic, the interference fit may keep the collapsible legs in place. Additionally, the collapsible leg may remain attached to the electrical connector after being pressed into a seated position, thereby eliminating debris.

In another example embodiment, such a stability system may include at least one peg. The peg, which may be a dual-diameter peg, may be molded to an edge of an electrical connector to engage with a respective opening on an electrical component. After the electrical connector is positioned onto the substrate, the smaller diameter of the peg may come into contact with the respective opening in the substrate. The electrical connector may then be pressed down slightly before being transported, such that the larger diameter of the peg beings to interfere with the respective opening, thereby providing increased stability during transportation.

In another example embodiment, such a stability system may include at least one collapsible peg that is large enough in diameter to provide additional stability. The collapsible peg may be molded onto the electrical connector behind a cored hole. When the electrical connector is placed into its respective position on the substrate, the collapsible peg may rest on the substrate acting as a back stop should the electrical connector begin to topple. When the connector is pressed into a seated position on the substrate, the collapsible peg may break down at its base, thereby collapsing into a recess in the electrical connector. The collapsible peg may be contained in the recess by the substrate, thereby eliminating debris.

DETAILED DESCRIPTION OF ILLUSTRATIVE EMBODIMENTS

Figure 1:
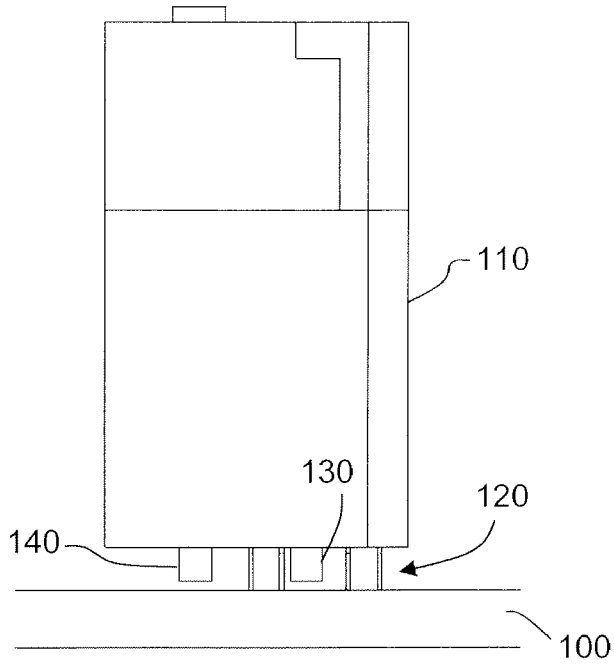
FIG. 1 (Prior Art)
FIG. 1 depicts a typical electrical connector without a stability system.

FIG. 1 depicts a typical electrical connector without a stability system. As illustrated in FIG. 1, the electrical connector includes a connector housing 110, one or more electrical contacts 120, and alignment posts 130 and 140. The electrical connector may be mounted to a substrate 100 such as a printed circuit board. For example, a plug connector may be loosely placed in communication with a receptacle connector on the substrate 100, thus creating a sub-assembly. The sub-assembly may then be transported to a pressing area, where the electrical connector may be press-fit onto the substrate 100. It is known that typical electrical connectors, such as the one illustrated in FIG. 1, tend to topple or tip over during transportation of the sub-assembly to the pressing area. Consequently, the electrical connector must be re-assembled to the substrate 100 before press fitting.

Figure 2A:
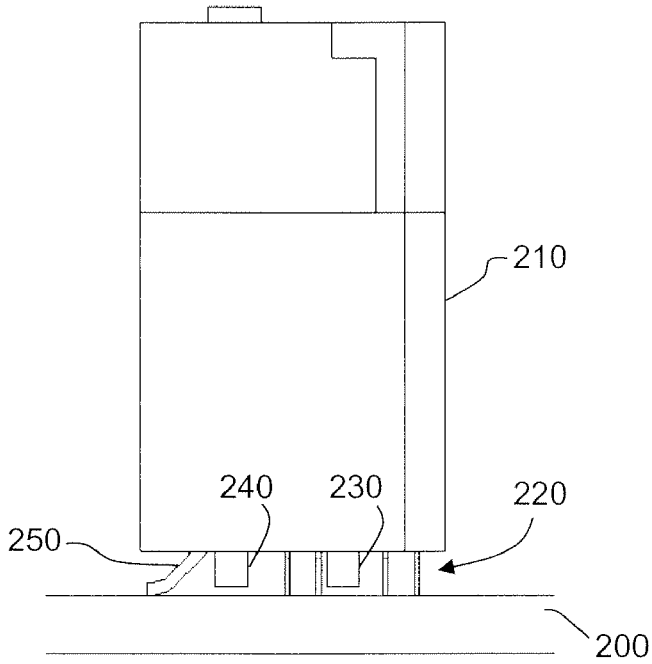
FIGS. 2A-2C depict an example embodiment of a stability system having a collapsible leg.

FIG. 2A depicts an example embodiment of a stability system as attached to an electrical connector. As illustrated in FIG. 2A, the electrical connector includes a connector housing 210, one or more electrical contacts 220, alignment posts 230 and 240, and a collapsible leg 250. The connector housing 210 may be made of, for example, a polymer such as plastic, thermoplastic, or the like. Additionally, the connector housing 210 may be manufactured by any technique such as injection molding, for example.

The connector housing 210 may include, a plurality of electrical contacts 220 that reside therein. The electrical contacts 220 may include terminal ends that extend from the bottom of the connector housing 210. The terminal ends of the electrical contacts 220 may be inserted into appropriate receptacles on a substrate 200 to provide an electrical connection to, for example, circuit traces on the substrate 200, which will be described in more detail below. The electrical contacts 220 may be connected to the substrate 200 in any other suitable manner, such that, the electrical contacts 220 provide electrical connections between the substrate 200 and additional electronic devices.

Extending from the bottom of the connector housing 210 may be alignment posts 230 and 240. The alignment posts 230 and 240 may be made of, for example, a polymer such as plastic, thermoplastic, or the like. The alignment posts 230 and 240 may be fixedly attached to the bottom of the connector housing 210 using, for example, an epoxy material. Alternatively, the connector housing 210 and the alignment posts 230 and 240 may be formed from a single piece of molded polymer using manufacturing techniques such as injection molding, for example. The alignment posts 230 and 240 may be received into apertures on the substrate 200 such that alignment posts 230 and 240 align the electrical contacts 220 in the electrical connector with the appropriate receptacles on the substrate 200.

The connector housing 210 may include a collapsible leg 250. As shown in FIG. 2A, in one embodiment, the collapsible leg 250 may be a protrusion from the electrical connector. The collapsible leg 250 may be made of, for example, a polymer such as plastic, thermoplastic, or the like. The collapsible leg 250 may be fixedly attached to the bottom of the connector housing 210 using, for example, an epoxy material. Alternatively, the collapsible leg 250 and the connector housing 210 may be formed from a single piece of molded polymer using manufacturing techniques such as injection molding, for example. The collapsible leg 250 may be positioned to impede the electrical connector from tipping in at least one direction relative to the substrate 200. For example, the collapsible leg 250 may be positioned offset from the center of gravity to provide stability to the electrical connector. Additionally, the collapsible leg 250 may be positioned closer to the front portion of the connector housing 210 than the alignment posts 230 and 240 to balance the connector housing 210 during transport to a pressing area.

As shown in FIG. 2A, the electrical connector may be connected to a substrate 200 to provide, for example, an electrical connection between the substrate 200 and additional electronic devices. The substrate 200 may include, for example, a printed circuit board. The printed circuit board may include a non-conductive substrate and a plurality of conductive pathways. The printed circuit board may electrically connect electronic components using conductive pathways. The conductive pathways may include, for example, traces that may be etched from copper sheets and laminated on the non-conductive substrate.

The electrical connector may be mounted to the substrate 200 creating a sub-assembly. For example, the alignment posts 230 and 240 and the electrical contacts 220 may be loosely placed in communication with respective apertures and receptacles on the substrate 200. As the alignment posts 230 and 240 are at least partially received by their respective apertures on the substrate 200, the collapsible leg 250 may contact the substrate. Because the collapsible leg 250 may be positioned offset from the center of gravity of the electrical connector, during transport of the sub-assembly to the pressing area, the collapsible leg 250 may prevent the electrical connector from tipping in at least one direction. For example, the collapsible leg 250 may rest on the substrate 200 acting as a back stop should the electrical connector begin to topple. Additionally, because the collapsible leg 250 may rest on the substrate 200, space on the substrate 200 may be saved and used to route signals to and from electrical devices, for example.

Figure 2B:
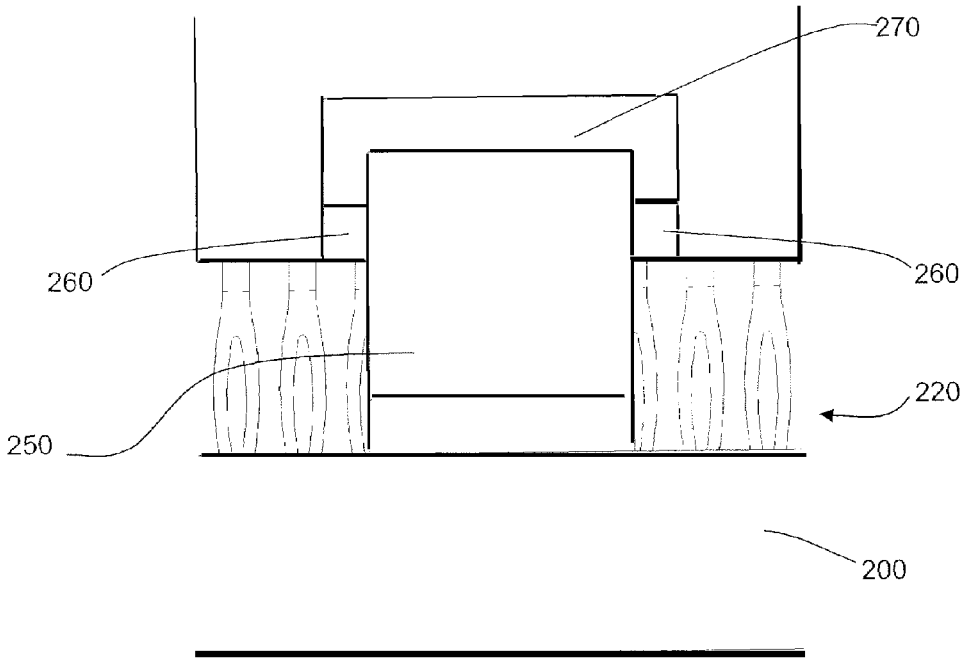
Figure 2C:
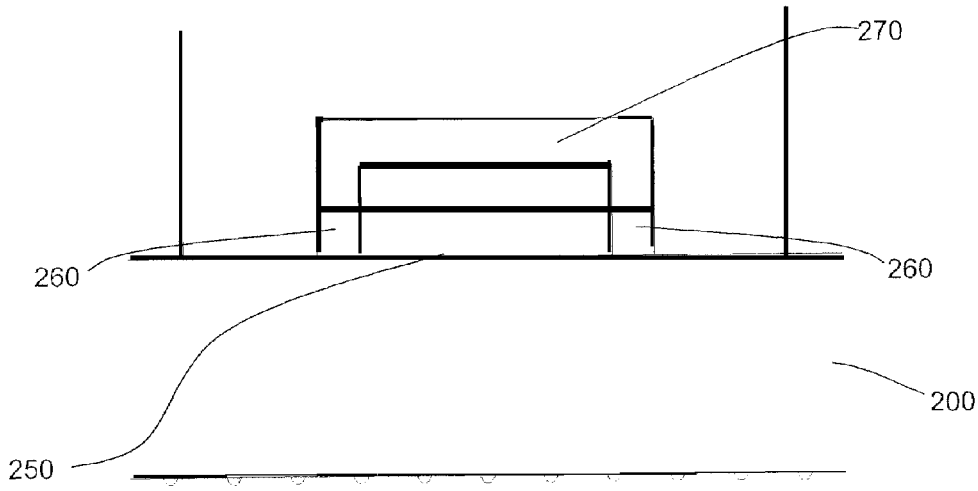

According to one embodiment, as shown in FIG. 2B, the collapsible leg 250 may be attached to the connector housing 210 using, for example, substances 260. Substances 260 may include a polymer such as plastic, thermoplastic, or the like. The connector housing 210 may also include a recess 270. As shown in FIG. 2C, the substances 260 may provide an interference fit for the collapsible leg 250 such that when the electrical connector is pressed to a seated position, the collapsible leg 250 may reside securely in the recess 270. The collapsible leg 250 may remain attached to the connector housing 210 after being pressed to a seated position, thereby eliminating debris.

Figure 3A:
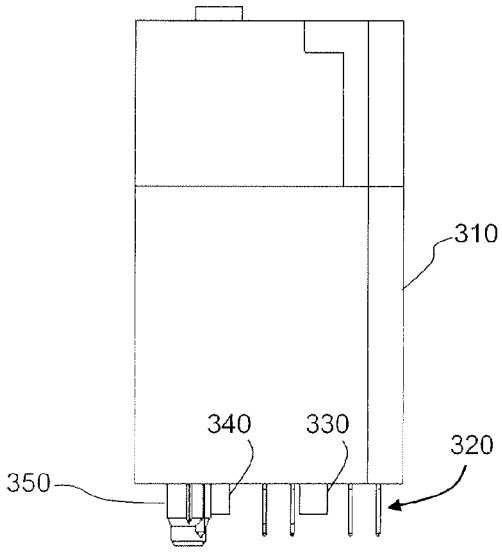
FIG. 3A-3C depict an example embodiment of a stability system having a peg.

FIG. 3A depicts another example embodiment of the stability system as attached to the electrical connector. As illustrated in FIG. 3A, the electrical connector includes a connector housing 310, one or more electrical contacts 320, alignment posts 330 and 340, and a peg 350. The connector housing 310 may be made of, for example, a polymer such as plastic, thermoplastic, or the like. Additionally, the connector housing 310 may be manufactured by any technique such as injection molding, for example.

The connector housing 310 may include, a plurality of electrical contacts 320 that reside therein. The electrical contacts 320 may include terminal ends that extend from the bottom of the connector housing 310. The terminal ends of the electrical contacts 320 may be inserted into appropriate receptacles on a substrate 300, shown in FIG. 3B, to provide an electrical connection to, for example, circuit traces on the substrate 300, which will be described in more detail below. The electrical contacts 320 may be connected to the substrate 300 in any other suitable manner, such that, the electrical contacts 320 provide electrical connections between the substrate 300 and additional electronic devices.

Extending from the bottom of the connector housing 310 may be alignment posts 330 and 340. The alignment posts 330 and 340 may be made of, for example, a polymer such as plastic, thermoplastic, or the like. The alignment posts 330 and 340 may be fixedly attached to the bottom of the connector housing 310 using, for example, an epoxy material. Alternatively, the connector housing 310 and the alignment posts 330 and 340 may be formed from a single piece of molded polymer using manufacturing techniques such as injection molding, for example. The alignment posts 330 and 340 may be received into apertures on the substrate 300, shown in FIG. 3B, such that the alignment posts 330 and 340 align the electrical contacts 320 in the electrical connector with the appropriate receptacles on the substrate 300.

Additionally, the connector housing 310 may include a peg 350. As shown in FIG. 3A, in one embodiment, the peg 350 may be a protrusion from the electrical connector. The peg 350 may be made of, for example, a polymer such as plastic, thermoplastic, or the like. The peg 350 may be fixedly attached to the bottom of the connector housing 310 using, for example, an epoxy material. Alternatively, the peg 350 and the connector housing 310 may be formed from a single piece of molded polymer using manufacturing techniques such as injection molding, for example. The peg 350 may include a larger diameter and a smaller diameter such that the larger diameter may contact the bottom of the connector housing 310. Additionally, the peg 350 may be positioned to impede the electrical connector from tipping in at least one direction relative to the substrate 300, shown in FIG. 3B. For example, the peg 350 may be positioned closer to the front portion of the connector housing 310 than the alignment posts 330 and 340 to balance the connector housing 310 during transport to a pressing area, which will be described in more detail below.

Figure 3B:
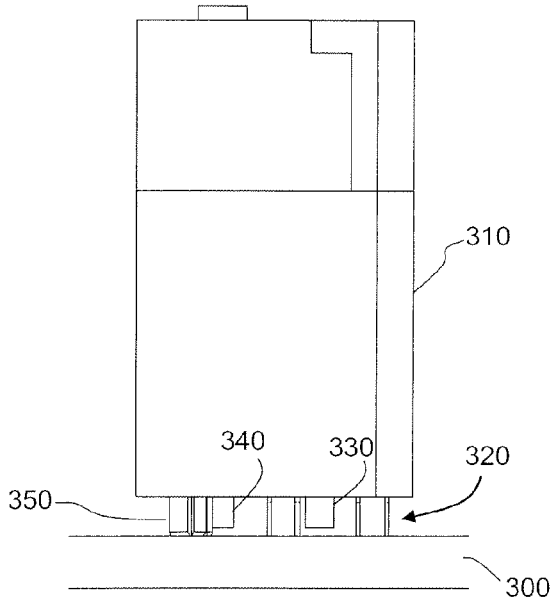

As shown in FIG. 3B, the electrical connector may be connected to the substrate 300 to provide, for example, an electrical connection between the substrate 300 and additional electronic devices. The substrate 300 may include, for example, a printed circuit board. The printed circuit board may include a non-conductive substrate and a plurality of conductive pathways. The printed circuit board may electrically connect electronic components using conductive pathways. The conductive pathways may include, for example, traces that may be etched from copper sheets and laminated on the non-conductive substrate.

Figure 3C:
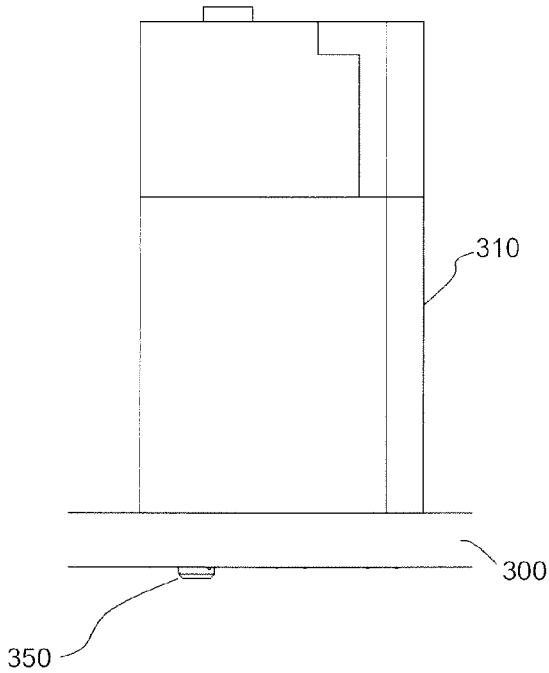

The electrical connector may be mounted to the substrate 300 creating a sub-assembly. For example, the alignment posts 330 and 340 and the electrical contacts 320 may be loosely placed in communication with respective apertures and receptacles on the substrate 300. As the alignment posts 330 and 340 are at least partially received by their respective apertures on the substrate 300, the smaller diameter of the peg 350 may be received by an opening on the substrate 300. As further pressure is placed on the connector housing 310, the opening on the substrate begins to securely surround the larger diameter of the peg 350. Because the larger diameter of the peg 350 begins to interfere with the opening, during transport of the sub-assembly to the pressing area, the peg 350 may prevent the electrical connector from tipping in at least one direction. After being transported to the pressing area, the electrical connector may be seated onto the substrate 300, as shown in FIG. 3C.

Figure 4A:
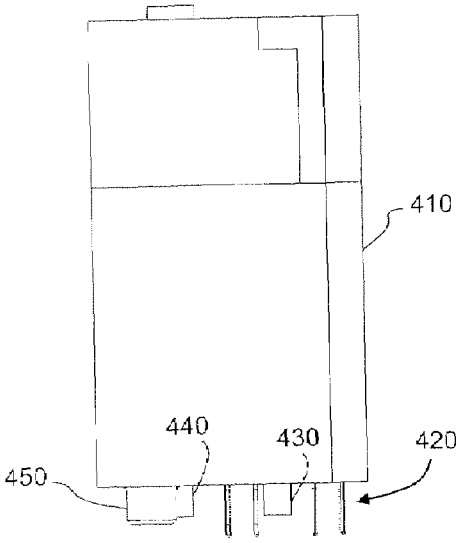
FIGS. 4A-4D depict an example embodiment of a stability system having a collapsible peg.

FIG. 4A depicts another example embodiment of the stability system as attached to an electrical connector. As illustrated in FIG. 4A, the electrical connector includes a connector housing 410, one or more electrical contacts 420, alignment posts 430 and 440, and a collapsible peg 450. The connector housing 410 may be made of, for example, a polymer such as plastic, thermoplastic, or the like. Additionally, the connector housing 410 may be manufactured by any technique such as injection molding, for example.

The connector housing 410 may include, a plurality of electrical contacts 420 that reside therein. The electrical contacts 420 may include terminal ends that extend from the bottom of the connector housing 410. The terminal ends of the electrical contacts 420 may be inserted into appropriate receptacles on a substrate 400, shown in FIG. 4B, to provide an electrical connection to, for example, circuit traces on the substrate 400, which will be described in more detail below. The electrical contacts 420 may be connected to the substrate 400 in any other suitable manner such that the electrical contacts 420 provide electrical connections between the substrate 400 and additional electronic devices.

Extending from the bottom of the connector housing 400 may be alignment posts 430 and 440. The alignment posts 430 and 440 may be made of, for example, a polymer such as plastic, thermoplastic, or the like. The alignment posts 430 and 440 may be fixedly attached to the bottom of the connector housing 410 using, for example, an epoxy material. Alternatively, the connector housing 410 and the alignment posts 430 and 440 may be formed from a single piece of molded polymer using manufacturing techniques such as injection molding, for example. The alignment posts 430 and 440 may be received into apertures on the substrate 400, shown in FIG. 4B, such that the alignment posts 430 and 440 align the electrical contacts 420 in the electrical connector with the appropriate receptacles on the substrate 400.

The connector housing 410 may include a collapsible peg 450. As shown in FIG. 4A, in one embodiment, the collapsible peg 450 may be a protrusion from the electrical connector. The collapsible peg 450 may be made of, for example, a polymer such as plastic, thermoplastic, or the like. The collapsible peg 450 may be fixedly attached to the bottom of the connector housing 410 using, for example, an epoxy material. As shown in FIGS. 4C-4D, the connector housing 410 may include a cored recess 460 such that the collapsible peg 450 may be placed directly below the core recess 460 on the connector housing 410. Additionally, the collapsible peg 450 and the corresponding cored recess 460 may be positioned to impede the electrical connector from tipping in at least one direction relative to the substrate 400. For example, the collapsible peg 450 and the corresponding cored recess 460 may be positioned offset from the center of gravity to provide stability to the electrical connector. Additionally, the collapsible peg 450 and the corresponding cored recess 460 may be positioned closer to the front portion of the connector housing 410 than the alignment posts 430 and 440 to balance the connector housing 410 during transport to a pressing area.

Figure 4B:
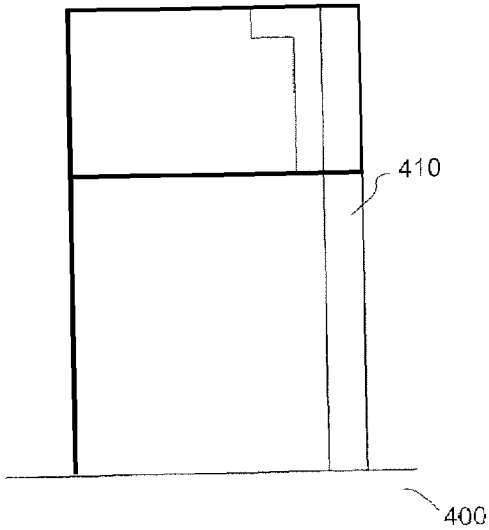
Figure 4C:
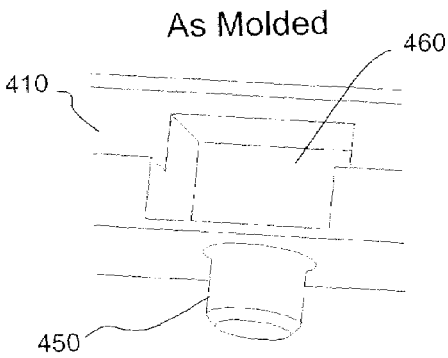
Figure 4D:
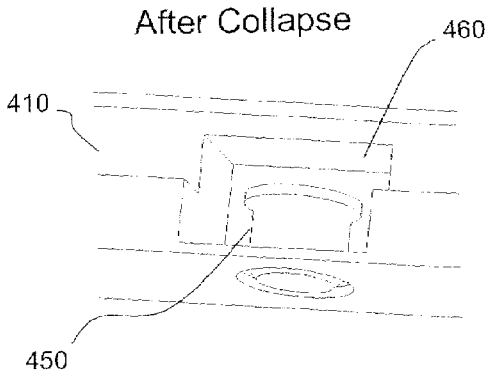

As shown in FIG. 4B, the electrical connector may be connected to the substrate 400 to provide, for example, an electrical connection between the substrate 400 and additional electronic devices. The substrate 400 may include, for example, a printed circuit board. The printed circuit board may include a non-conductive substrate and a plurality of conductive pathways. The printed circuit board may electrically connect electronic components using conductive pathways. The conductive pathways may include, for example, traces that may be etched from copper sheets and laminated on the non-conductive substrate.

The electrical connector may be mounted to the substrate 400 creating a sub-assembly. For example, the alignment posts 430 and 440 and the electrical contacts 420 may be loosely placed in communication with respective apertures and receptacles on the substrate 400. As the alignment posts 430 and 440 are at least partially received by their respective apertures on the substrate 400, the collapsible peg 450 may contact the substrate. Because the collapsible peg 450 may be positioned offset from the center of gravity of the electrical connector, during transport of the sub-assembly to the pressing area, the collapsible peg 450 may prevent the electrical connector from tipping in at least one direction. For example, the collapsible peg 450 may rest on the substrate 400 acting as a back stop should the electrical connector begin to topple. Additionally, because the collapsible peg 450 may rest on the substrate 400, space on the substrate 400 may be saved and used to route signals to and from electrical devices, for example.

After being transported to the pressing area, the electrical connector may be seated onto the substrate 400, as shown in FIG. 4B. As shown in FIGS. 4B-4D, when the electrical connector is pressed into a seated position, the collapsible peg 450 may break at its base. Upon further pressure, the collapsible peg 450 may be pushed into the cored recess 460 resulting in some interference. The resulting interference may secure the collapsible peg 450 into the recess 460. Thus, the collapsible peg 450 may be contained in the recess 460 by the substrate 400, thereby eliminating debris.

Though all embodiments show a protrusion extending farther from bottom of housing than alignment posts do, it should be understood that the protrusion need not extend farther, as long as it extends far enough to impede tipping of the connector when the alignment posts are received into the aperture.

The invention claimed is:

1. An electrical connector system comprising:

a connector housing defining a bottom portion and a recess;

a first alignment post and a second alignment post that extend from the bottom portion of the connector housing, the first alignment post and the second alignment post defining a respective first length and second length, the first alignment post and the second alignment post being adapted to be received into corresponding apertures defined by a substrate; and a protrusion that extends from the bottom portion of the connector housing, the protrusion defining a third length that is greater than the first length and the second length, and the protrusion being adapted to impede the connector system from tipping in at least one direction relative to the substrate when the first alignment post and the second alignment post are at least partially received into the corresponding apertures the corresponding aperture, and the protrusion being adapted to collapse into the recess defined by the connector housing.

2. The electrical connector according to claim 1, wherein the connector housing further defines a front portion, and wherein the protrusion is positioned closer to the front portion than the first alignment post.

3. The electrical connector of claim 2, wherein the protrusion includes a collapsible leg, the collapsible leg being adapted to collapse into the recess defined by the connector housing.

4. The electrical connector of claim 2, wherein the protrusion includes a collapsible peg, the collapsible peg being adapted to collapse into the recess defined by the connector housing.

5. The electrical connector of claim 1, wherein the protrusion is adapted to collapse in a direction relative to the first alignment post and the second alignment post being received in the corresponding aperture defined by the substrate.

6. The electrical connector of claim 1, wherein the protrusion is positioned offset from a center of gravity of the electrical connector.

7. The electrical connector of claim 3, wherein the collapsible leg is molded to the connector housing.

8. The electrical connector of claim 3, wherein the collapsible leg is attached to the connector housing using a substance and wherein the substance provides an interference fit that secures the collapsible leg in the recess.

9. The electrical connector of claim 8, wherein the substance comprises one or more webs of plastic.

10. The electrical connector of claim 4, wherein the recess comprises a cored hole defined the connecting housing.

11. The electrical connector of claim 10, wherein the collapsible peg is molded on the connector housing behind the cored hole.

12. The electrical connector of claim 4, wherein the collapse peg defines a base, and wherein the base is adapted to break down when the collapsible peg collapses into the recess defined by the connector housing.

* * * * *

UNITED STATES PATENT AND TRADEMARK OFFICE

CERTIFICATE OF CORRECTION

PATENT NO. : 7,445,500 B2
APPLICATION NO. : 11/627767
DATED : November 4, 2008
INVENTOR(S) : Daniel B. Bertoncini et al.

It is certified that error appears in the above-identified patent and that said Letters Patent is hereby corrected as shown below:

Col. 8 Claim 15, line 61, delete "and" before "the protrusion being . . ."

Col. 8 Claim 15, line 65, delete "the corresponding apertures"

Signed and Sealed this

Second Day of February, 2010

David J. Kappos

David J. Kappos
*Director of the United States Patent and Trademark Office*